US010935913B1

(12) United States Patent
Hara

(10) Patent No.: US 10,935,913 B1
(45) Date of Patent: Mar. 2, 2021

(54) FIXING DEVICE INCLUDING AT LEAST ONE TEMPERATURE SENSING UNIT THAT SENSES A TEMPERATURE OF A LUBRICANT

(71) Applicant: FUJI XEROX CO., LTD., Tokyo (JP)

(72) Inventor: Toko Hara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/853,767

(22) Filed: Apr. 21, 2020

(30) Foreign Application Priority Data

Oct. 3, 2019 (JP) ..... JP2019-183151

(51) Int. Cl.
*G03G 15/20* (2006.01)

(52) U.S. Cl.
CPC ..... *G03G 15/2053* (2013.01); *G03G 15/2025* (2013.01); *G03G 15/2042* (2013.01); *G03G 15/2064* (2013.01); *G03G 2215/2038* (2013.01)

(58) Field of Classification Search
CPC ..... G03G 15/2025; G03G 15/2039; G03G 15/2042; G03G 15/2053
USPC ..... 399/67, 69, 329
See application file for complete search history.

(56) References Cited

U.S. PATENT DOCUMENTS 6,157,806 A * 12/2000 Elbert et al. ..... G03G 15/2064 399/329
8,606,135 B2 * 12/2013 Yamashina et al. ..... G03G 15/2053 399/67
8,938,193 B2 * 1/2015 Suzuki et al. ..... G03G 15/2053 399/329
8,942,589 B2 1/2015 Asami et al.

FOREIGN PATENT DOCUMENTS

JP 2013156570 8/2013
JP 2014174503 9/2014

* cited by examiner

*Primary Examiner* — William J Royer
(74) *Attorney, Agent, or Firm* — JCIPRNET

(57) ABSTRACT

A fixing device includes an annular and rotatable fixing member, a contact member, at least one temperature sensing unit, and a processor. The fixing member has an outer peripheral surface that comes into contact with a recording medium. The fixing member fixes an image on the recording medium onto the recording medium. The contact member is in contact with an inner peripheral surface of the fixing member, and extends in an axial direction of the fixing member. The at least one temperature sensing unit senses a temperature of a lubricant adhering to the inner peripheral surface of the fixing member. The processor controls rotation of the fixing member on a basis of a temperature sensed by the at least one temperature sensing unit.

14 Claims, 7 Drawing Sheets

FIXING DEVICE INCLUDING AT LEAST ONE TEMPERATURE SENSING UNIT THAT SENSES A TEMPERATURE OF A LUBRICANT

CROSS-REFERENCE TO RELATED APPLICATIONS

This application is based on and claims priority under 35 USC 119 from Japanese Patent Application No. 2019-183151 filed Oct. 3, 2019.

BACKGROUND

(i) Technical Field

The present disclosure relates to a fixing device and an image forming apparatus.

(ii) Related Art

Japanese Unexamined Patent Application Publication No. 2013-156570 discloses processing of changing distribution of a temperature of a heater in a longitudinal direction to adjust an inverted crown amount of a pressing roller.

Japanese Unexamined Patent Application Publication No. 2014-174503 discloses a fixing device. The fixing device includes an endless belt member, a fixing member fixed to be in contact with an inner circumferential surface of the belt member, a support roller that rotatably supports the belt member while being in contact with the belt member, and a heating device that heats the belt member.

SUMMARY

A device that fixes an image on a recording medium onto the recording medium includes an annular and rotatable fixing member. To enhance lubrication between the fixing member and a member that is in contact with the fixing member over each other, a lubricant may be applied to the fixing member.

Here, when the temperature of the lubricant varies, the fixing member moves smoothly over a portion with the lubricant with a high temperature, and moves less smoothly over a portion with the lubricant with a low temperature. In this structure, the fixing member is more likely to be deformed, and this deformation of the fixing member may degrade the quality of an image fixed onto a recording medium or break the fixing member.

Aspects of non-limiting embodiments of the present disclosure relate to prevent deformation of a fixing member due to variation of the temperature of a lubricant, unlike in a case where rotation of the fixing member is controlled without taking the temperature of the lubricant into consideration.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided a fixing device including an annular and rotatable fixing member, a contact member, at least one temperature sensing unit, and a processor. The fixing member has an outer peripheral surface that comes into contact with a recording medium. The fixing member fixes an image on the recording medium onto the recording medium. The contact member is in contact with an inner peripheral surface of the fixing member, and extends in an axial direction of the annular fixing member. The at least one temperature sensing unit senses a temperature of a lubricant adhering to the inner peripheral surface of the fixing member. The processor controls rotation of the fixing member on a basis of a temperature sensed by the at least one temperature sensing unit.

BRIEF DESCRIPTION OF THE DRAWINGS

Exemplary embodiments of the present disclosure will be described in detail based on the following figures, wherein.

DETAILED DESCRIPTION

Exemplary embodiments of the present disclosure will be described below with reference to the attached drawings.

Figure 1:
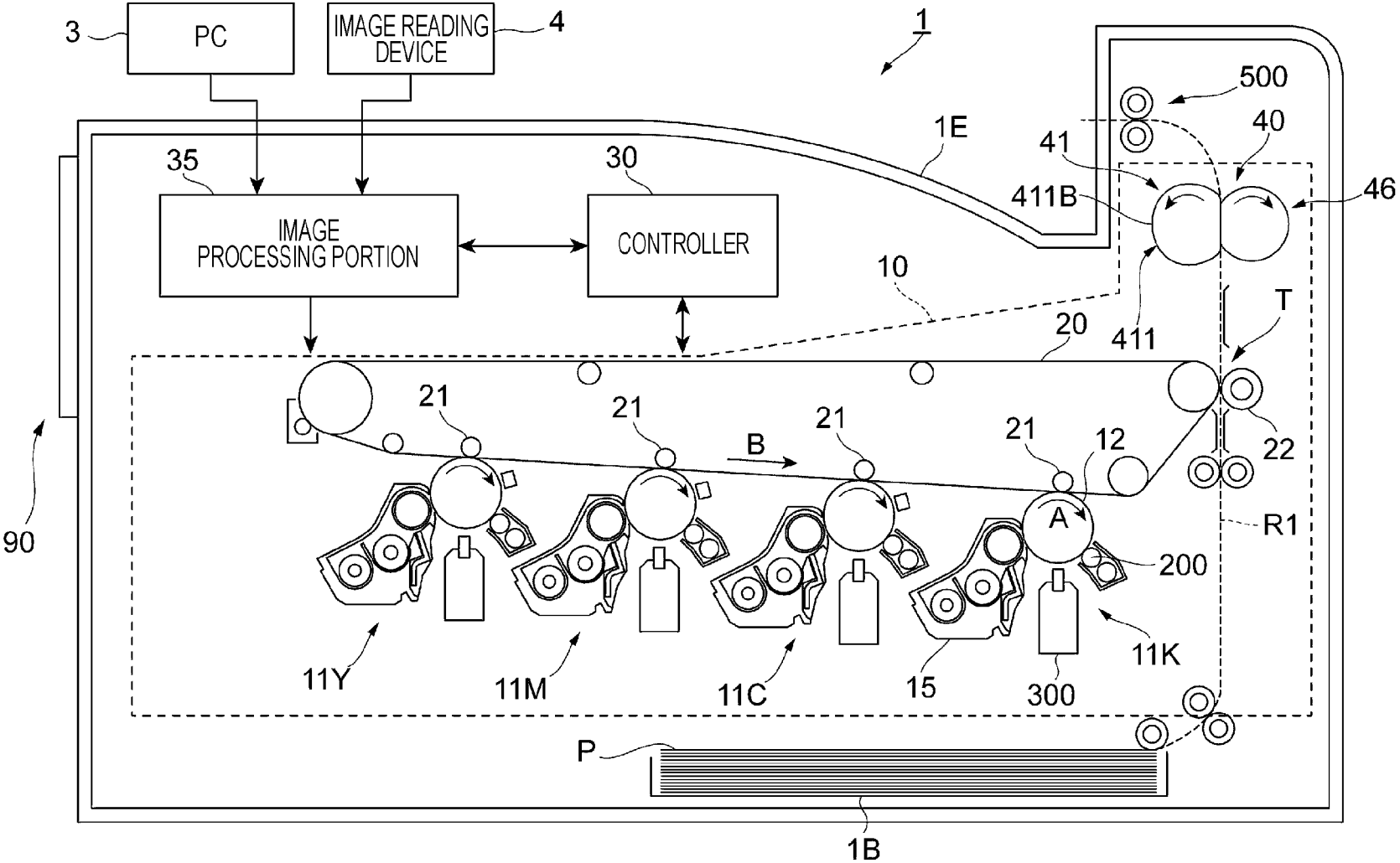
FIG. 1 is an entire structure of an image forming apparatus.

FIG. 1 illustrates an entire structure of an image forming apparatus 1. More specifically, FIG. 1 is a view of the image forming apparatus 1 viewed from the front side of the image forming apparatus 1.

The image forming apparatus 1 is a so-called tandem color printer.

The image forming apparatus 1 includes an image forming portion 10, as an example of an image forming device. The image forming portion 10 performs image formation on a sheet P, which is an example of a recording medium, based on image data for different colors.

The image forming apparatus 1 also includes a controller 30 and an image processing portion 35. The image forming apparatus 1 also includes a display device 90.

The display device 90 is formed from a touch screen to display information. The display device 90 receives information input from a user.

The controller 30 controls functional units of the image forming apparatus 1. The image processing portion 35 performs image processing on image data from, for example, a personal computer (PC) 3 or an image reading device 4.

Figure 2:
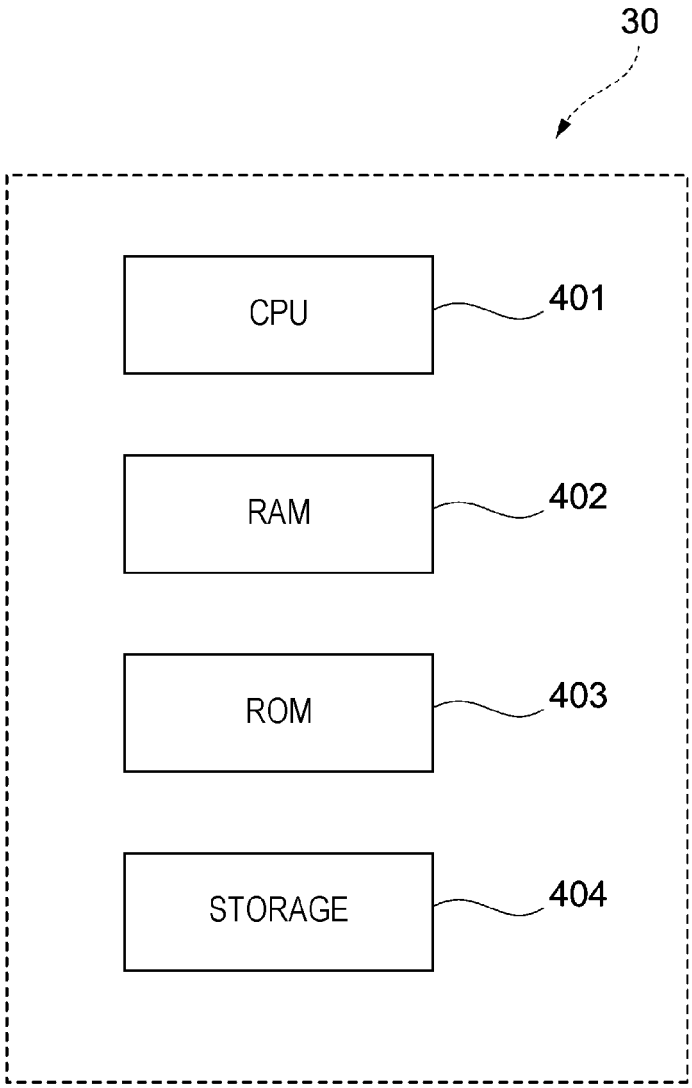
FIG. 2 illustrates a structure of a controller.

As illustrated in FIG. 2 (illustrating the structure of the controller 30), the controller 30 includes a central processing unit (CPU) 401, which is an example of a processor, a random access memory (RAM) 402, a read only memory (ROM) 403, and a storage 404 formed from, for example, a hard disk.

The ROM 403 and the storage 404 store programs executed by the CPU 401. The CPU 401 reads programs stored in the ROM 403 or the storage 404 to execute the programs using the RAM 402 as a work area.

The CPU 401 implements the following functions by executing the programs stored in the ROM 403 or the storage 404.

The programs to be executed by the CPU 401 may be provided to the image forming apparatus 1 in the form of being stored in a computer-readable recording medium such as a magnetic recording medium (such as a magnetic tape or a magnetic disk), an optical recording medium (such as an optical disk), an optical magnetic recording medium, or a semiconductor memory. The programs executed by the CPU 401 may also be provided to the image forming apparatus 1 through a communication device such as the Internet.

In the present exemplary embodiment, a processor refers to a broadly interpreted processor, and includes a general-purpose processor (such as a central processing unit (CPU)), and an exclusive-use processor (such as a graphics processing unit (GPU), an application specific integrated circuit (ASIC), a field programmable gate array (FPGA), or a programable logical device).

The operation may be performed not only by a single processor, but also by multiple processors physically spaced apart from each other in cooperation. The order in which processing is performed by the processor is not limited to the order described in the present exemplary embodiment, but may be changed.

The image forming apparatus 1 will be described further with reference to FIG. 1.

The image forming portion 10 includes four image forming units 11Y, 11M, 11C, and 11K (hereinafter also simply referred to as image forming units 11, collectively) arranged side by side at regular intervals.

The image forming units 11 have the same structure except for accommodating different types of toner in respective developing devices 15. The image forming units 11 form toner images (images) of yellow (Y), magenta (M), cyan (C), and black (K).

Each image forming unit 11 includes a photoconductor drum 12, a charging device 200, which electrically charges the photoconductor drum 12, and a LED print head (LPH) 300, which exposes the photoconductor drum 12 to light.

The photoconductor drum 12 is electrically charged by the charging device 200. The photoconductor drum 12 is also exposed to light by the LPH 300 to have an electrostatic latent image formed thereon.

Each image forming unit 11 also includes a developing device 15, which develops an electrostatic latent image formed on the photoconductor drum 12, and a cleaner (not illustrated) that cleans the surface of the photoconductor drum 12.

The image forming portion 10 includes an intermediate transfer belt 20, to which toner images of different colors formed by the photoconductor drums 12 are transferred, and first transfer rollers 21, which sequentially transfer (first-transfer) the toner images of different colors formed by the photoconductor drums 12 to the intermediate transfer belt 20.

The image forming portion 10 also includes a second transfer roller 22, which collectively transfers (second-transfers) the toner images transferred onto the intermediate transfer belt 20 to a sheet P, and a fixing device 40, which fixes the toner images transferred to the sheet P onto the sheet P.

The fixing device 40 includes a fixing belt module 41 including a heat source, and a pressing roller 46.

The fixing belt module 41 is disposed on the left of a sheet transport path R1 in the drawing. The pressing roller 46 is disposed on the right of the sheet transport path R1 in the drawing. The pressing roller 46 is pressed against the fixing belt module 41.

The fixing belt module 41 includes a film-shaped fixing belt 411, which comes into contact with the sheet P. The fixing belt 411 is a fixing member used to fix the toner image (image) on a sheet P onto the sheet P.

The fixing belt 411 includes, for example, a release layer disposed outermost to come into contact with the sheet P, an elastic layer disposed adjacent to and on the inner side of the release layer, and a base layer that supports the elastic layer.

The fixing belt 411 is annular and rotatable to rotate counterclockwise in the drawing. In other words, the fixing belt 411 is endless and circularly moves along a predetermined path.

The fixing belt 411 is in contact with the sheet P transported from below in the drawing. More specifically, the fixing belt 411 has an outer peripheral surface 411B, which comes into contact with the sheet P.

The portion of the fixing belt 411 that is in contact with the sheet P moves together with the sheet P. The fixing belt 411 holds the sheet P together with the pressing roller 46 to press and heat the sheet P.

The fixing belt module 41 also includes a heat source (described below) on the inner side of the fixing belt 411 to heat the fixing belt 411.

The pressing roller 46 serving as an example of a pressing member is disposed on the right side of the sheet transport path R1 in the drawing. The pressing roller 46 is pressed against the outer peripheral surface 411B of the fixing belt 411 to press the sheet P passing between the fixing belt 411 and the pressing roller 46.

The pressing roller 46 is rotated clockwise in the drawing by a motor not illustrated. When the pressing roller 46 rotates clockwise, the fixing belt 411 rotates counterclockwise with the driving force received from the pressing roller 46.

In the image forming apparatus 1, the image processing portion 35 performs image processing on image data from the PC 3 or the image reading device 4, and the image data undergoing image processing is fed to each image forming unit 11.

Then, for example, in the image forming unit 11K for black (K), the photoconductor drum 12 is electrically charged by the charging device 200 while rotating in the direction of arrow A, and exposed to light emitted from the LPH 300 on the basis of the image data transmitted from the image processing portion 35.

Thus, an electrostatic latent image for an image for black (K) is formed on the photoconductor drum 12. The electrostatic latent image formed on the photoconductor drum 12 is developed by the developing device 15 into a toner image for black (K) formed on the photoconductor drum 12.

Similarly, the image forming units 11Y, 11M, and 11C respectively form toner images of yellow (Y), magenta (M), and cyan (C).

The toner images of respective colors formed by the respective image forming units 11 are sequentially electrostatically attracted by the first transfer rollers 21 to the intermediate transfer belt 20 moving in the direction of arrow B, so that a superposed toner image including toner of different colors is formed on the intermediate transfer belt 20.

The toner image formed on the intermediate transfer belt 20 is transported to a position (second transfer portion T) of the second transfer roller 22 with the movement of the intermediate transfer belt 20. At the timing when the toner image is transported to the second transfer portion T, a sheet P is fed from a sheet container 1B to the second transfer portion T.

At the second transfer portion T, the toner image on the intermediate transfer belt 20 is collectively and electrostatically transferred to the sheet P transported to the second transfer portion T with a transfer electric field formed by the second transfer roller 22.

Thereafter, the sheet P to which the toner image is electrostatically transferred is separated from the intermediate transfer belt 20, and transported to the fixing device 40.

The fixing device 40 holds the sheet P between the fixing belt module 41 and the pressing roller 46. More specifically, the fixing device 40 holds the sheet P with the fixing belt 411, circularly moving counterclockwise, and the pressing roller 46, rotating clockwise.

Thus, the sheet P undergoes pressing and heating to have a toner image thereon fixed thereto. The sheet P undergoing fixing is transported to a sheet receiver lE by discharging rollers 500.

Figure 3:
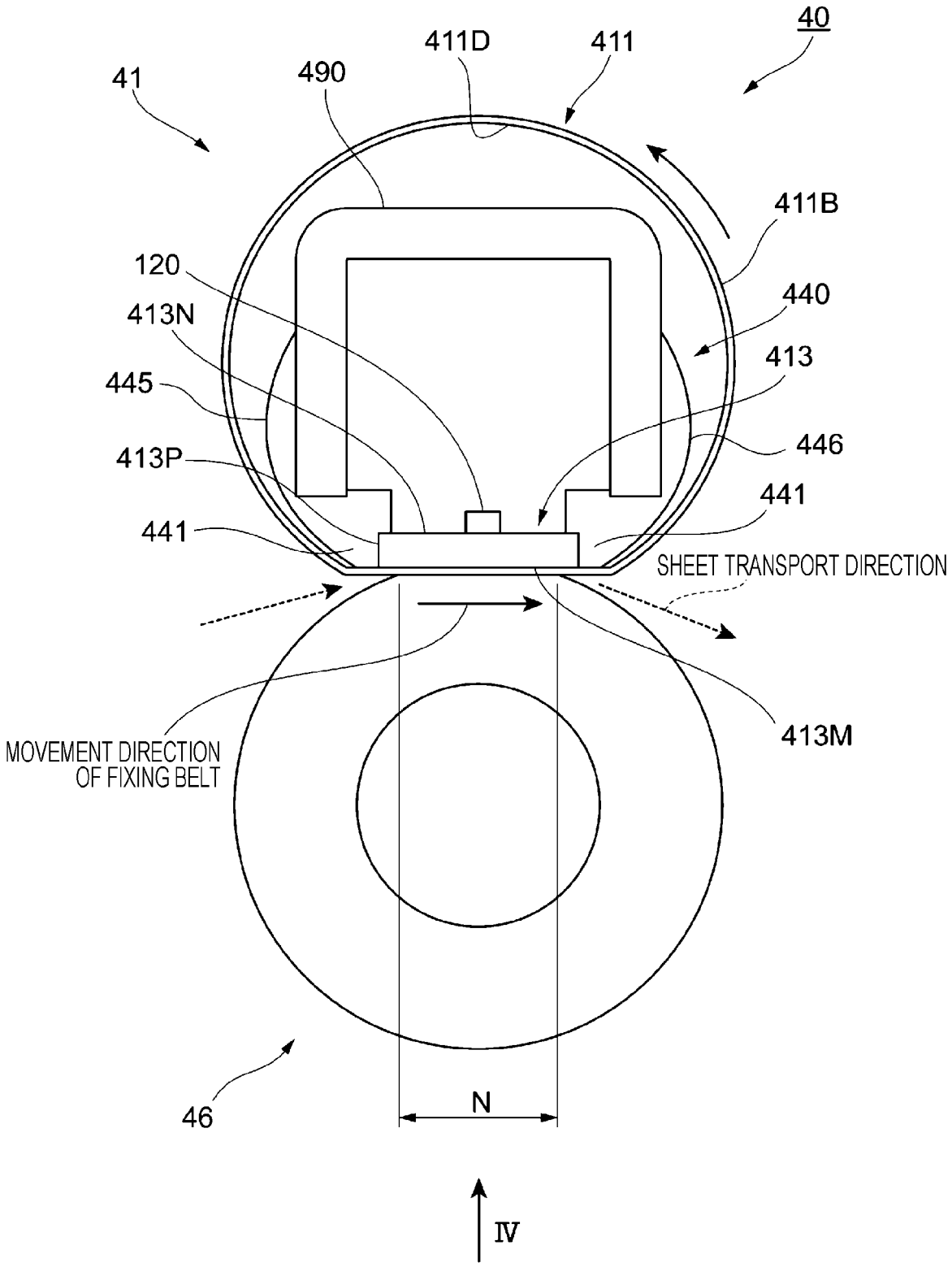
FIG. 3 illustrates a structure of a fixing device.

FIG. 3 illustrates a structure of the fixing device 40.

As illustrated in FIG. 3, the fixing device 40 includes the fixing belt module 41 and the pressing roller 46.

The fixing belt module 41 includes the fixing belt 411 to fix the toner image onto the sheet P. The fixing belt 411 is pressed against the surface of the sheet P on which the toner image is formed.

Here, in the present exemplary embodiment, to enhance lubrication between the fixing belt 411 and a heat source, described below, a lubricant is applied to an inner peripheral surface 411D of the fixing belt 411, so that the lubricant adheres to the inner peripheral surface 411D of the fixing belt 411.

The lubricant may be of any type, for example, silicone oil or fluorinated grease.

The pressing roller 46, which is an example of a pressing member, is pressed against the outer peripheral surface 411B of the fixing belt 411 to press the sheet P passing through the fixing belt 411 and the pressing roller 46.

Specifically, the pressing roller 46 forms, between itself and the fixing belt 411, a nip portion N, which is an area that comes into contact with the outer peripheral surface 411B of the fixing belt 411 and over which the sheet P passes while being pressed.

In the present exemplary embodiment, in the process where the sheet P passes over the nip portion N, the sheet P is heated and pressed to have a toner image fixed thereto.

A heat source 413, which is an example of a heating member that heats the fixing belt 411, is disposed on the inner side of the fixing belt 411.

The heat source 413 is disposed in contact with the inner peripheral surface 411D of the fixing belt 411. The heat source 413 extends in the axial direction of the annular fixing belt 411. In other words, the heat source 413 extends in the axial direction of the fixing belt 411.

The heat source 413 extends in the direction crossing the movement direction of the fixing belt 411. More specifically, the heat source 413 extends in the direction perpendicular to the plane of FIG. 3.

Here, the heat source 413 may be regarded as a contact member that comes into contact with the fixing belt 411.

A support member 440, which supports the heat source 413, is also disposed on the inner side of the fixing belt 411. The support member 440 includes support portions 441, which support the heat source 413.

At a portion opposing a first surface of the heat source 413, temperature sensors 120, which are an example of temperature sensing units that sense the temperature of the lubricant adhering to the inner peripheral surface 411D of the fixing belt 411, are disposed.

More specifically, in the present exemplary embodiment, the temperature sensors 120 are disposed at portions opposing a reverse surface 413N of the heat source 413 on the side opposite to an opposing surface 413M of the heat source 413 opposing the fixing belt 411.

In the present exemplary embodiment, the temperature of the lubricant changes in accordance with the temperature of the heat source 413. In the present exemplary embodiment, the temperature of the lubricant is sensed by sensing the temperature of the heat source 413.

Figure 4:
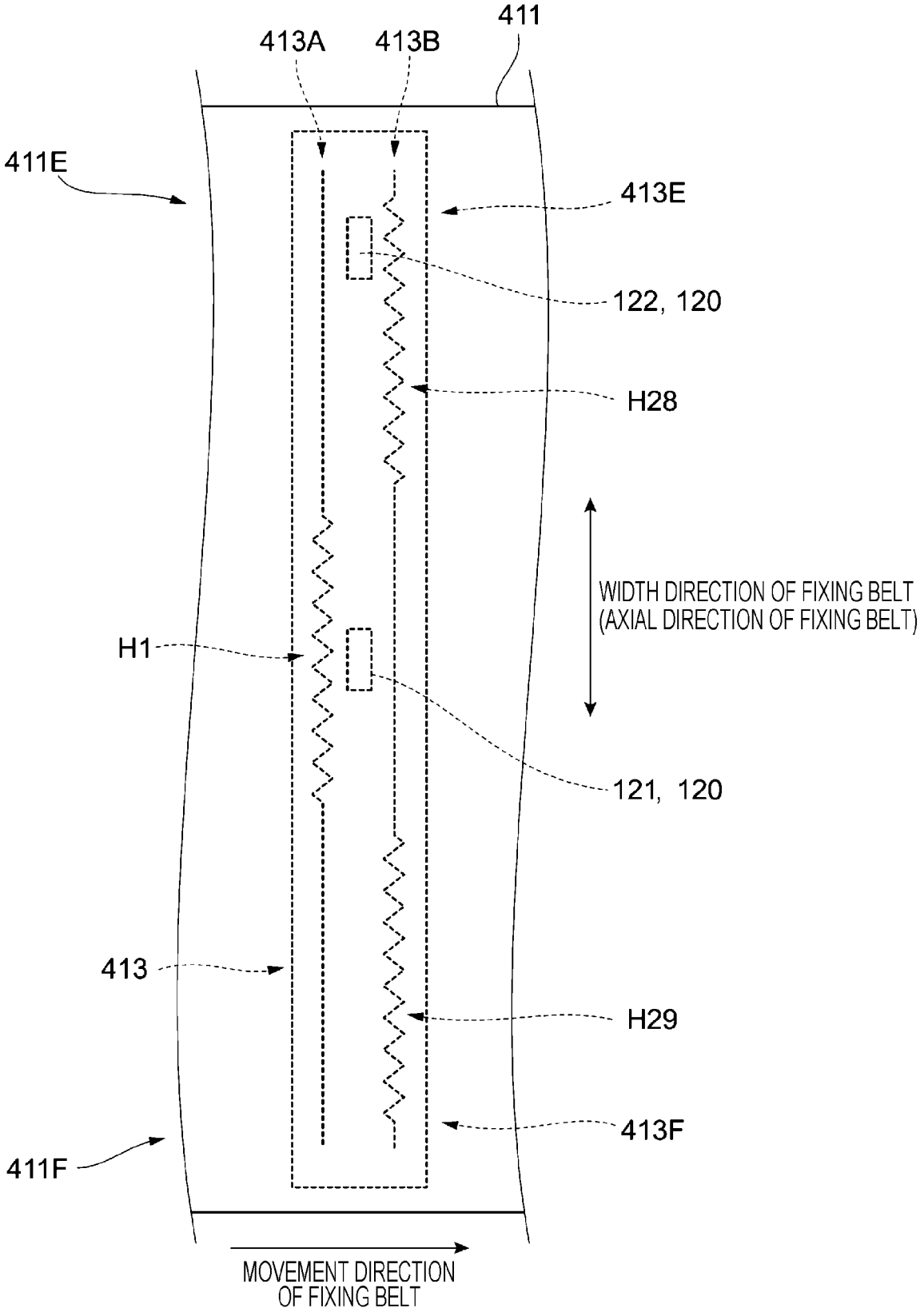
FIG. 4 illustrates a fixing belt, a heat source, and temperature sensors viewed in a direction of arrow IV in FIG. 3.

FIG. 4 illustrates the fixing belt 411, the heat source 413, and the temperature sensors 120, viewed in the direction of arrow IV in FIG. 3.

The heat source 413 includes a first heating element 413A and a second heating element 413B, extending in the longitudinal direction of the heat source 413.

The first heating element 413A and the second heating element 413B are disposed at different positions in the movement direction of the fixing belt 411.

The first heating element 413A includes a heating unit H1. The heating unit H1 is located at the center of the heat source 413 in the longitudinal direction of the heat source 413. Herein, the heating unit H1 of the first heating element 413A is referred to as "a central heating unit H1".

The second heating element 413B includes a first end heating unit H28 and a second end heating unit H29. The first end heating unit H28 is located at a first end 413E in the longitudinal direction of the heat source 413, and the second end heating unit H29 is located at a second end 413F in the longitudinal direction of the heat source 413.

Here, in the present exemplary embodiment, outputs (heat generated per unit time) from the first end heating unit H28 and the second end heating unit H29 are greater than an output (heat generated per unit time) from the central heating unit H1 of the first heating element 413A.

The present exemplary embodiment includes multiple temperature sensors 120.

Specifically, the present exemplary embodiment includes a central temperature sensor 121 and an end temperature sensor 122 as the temperature sensors 120.

The central temperature sensor 121 and the end temperature sensor 122 are arranged at different positions in the axial direction of the fixing belt 411. More specifically, the central temperature sensor 121 and the end temperature sensor 122 are arranged at different positions in the longitudinal direction of the heat source 413.

The central temperature sensor 121 is disposed at the center of the fixing belt 411 in the axial direction of the fixing belt 411 to sense the temperature of the lubricant located at the center of the fixing belt 411 in the axial direction of the fixing belt 411.

More specifically, the central temperature sensor 121 is located at a portion opposing the center of the heat source 413 in the longitudinal direction of the heat source 413 to sense the temperature of the lubricant at a portion opposing the center of the heat source 413 in the longitudinal direction of the heat source 413.

The end temperature sensor 122 is disposed at a first end 411E in the axial direction of the fixing belt 411 to sense the temperature of the lubricant located at the first end 411E in the axial direction of the fixing belt 411.

More specifically, the end temperature sensor 122 is disposed at a portion opposing the first end 413E in the longitudinal direction of the heat source 413 to sense the temperature of the lubricant located at a portion opposing the first end 413E in the longitudinal direction of the heat source 413.

The heat source 413 has a plate shape to extend in the movement direction of the fixing belt 411 and in the width direction of the fixing belt 411.

More specifically, as illustrated in FIG. 4, the heat source 413 is rectangular when viewed from the front, and has its longitudinal direction coinciding with the width direction of the fixing belt 411.

Here, the width direction of the fixing belt 411 coincides with the direction perpendicular to the movement direction of the fixing belt 411. The width direction of the fixing belt 411 also coincides with the axial direction of the annular fixing belt 411.

In the present exemplary embodiment, the heat source 413 extends from the first end 411E to a second end 411F in the axial direction of the fixing belt 411.

In the present exemplary embodiment, heat is fed from the heat source 413 to the fixing belt 411 to heat the fixing belt 411.

As illustrated in FIG. 3, the heat source 413 includes the opposing surface 413M, which opposes the fixing belt 411, the reverse surface 413N, which is located opposite to the opposing surface 413M, and side surfaces 413P, which connect the opposing surface 413M and the reverse surface 413N to each other.

In the present exemplary embodiment, the central temperature sensor 121 and the end temperature sensor 122 are disposed to face the reverse surface 413N.

In the present exemplary embodiment, as illustrated in FIG. 3, the pressing roller 46 is pressed against the heat source 413 with the fixing belt 411 interposed therebetween.

In the present exemplary embodiment, the pressing roller 46 is movable toward and away from the fixing belt module 41. The pressing roller 46 is spaced apart from the fixing belt module 41 while, for example, not performing a fixing operation. In this case, the fixing belt 411 and the pressing roller 46 are not in contact with each other.

As illustrated in FIG. 3, in the present exemplary embodiment, the support member 440 includes an upstream guide 445 and a downstream guide 446.

The upstream guide 445 is disposed upstream of the heat source 413 in the rotation direction (movement direction) of the fixing belt 411. The upstream guide 445 comes into contact with a portion of the fixing belt 411 upstream of the heat source 413 to guide this upstream portion.

The downstream guide 446 is located downstream of the heat source 413 in the rotation direction of the fixing belt 411.

The downstream guide 446 comes into contact with a portion of the fixing belt 411 located downstream of the heat source 413 to guide this downstream portion.

The fixing belt module 41 also includes a support frame 490 as an internal component. The support frame 490 is disposed on the inner side of the fixing belt 411 to support the components disposed on the inner side of the fixing belt 411.

Specifically, the support frame 490 supports components disposed on the inner side of the fixing belt 411, such as the support member 440 and the heat source 413.

Figure 5:
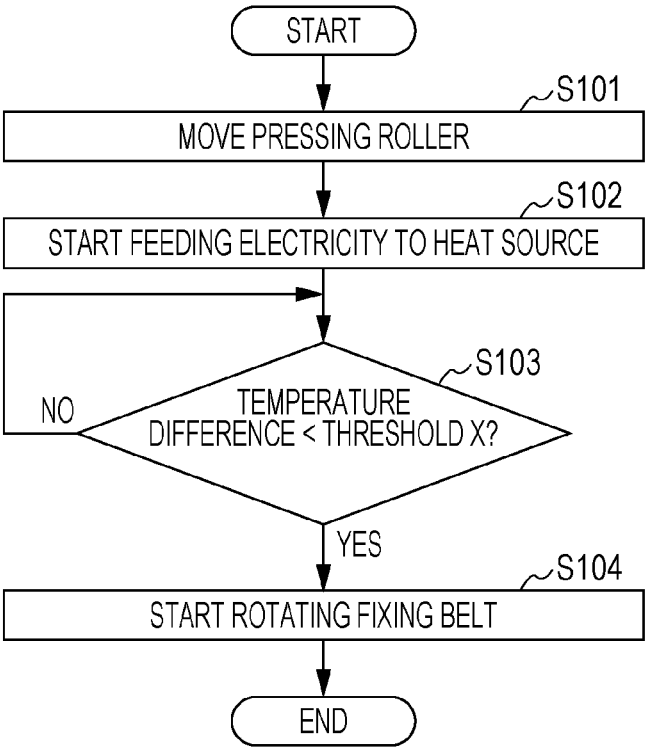
FIG. 5 is a flowchart of processing relating to a fixing operation executed by a CPU of a controller.

FIG. 5 is a flowchart of processing relating to a fixing operation executed by the CPU 401 of the controller 30.

In the present exemplary embodiment, at the beginning of image formation, the CPU 401 firstly moves the pressing roller 46 (step S101) to press the pressing roller 46 against the fixing belt module 41.

Subsequently, the CPU 401 starts feeding electricity to the heat source 413 (first heating element 413A and second heating element 413B) (step S102) to cause the heat source 413 to generate heat.

Thereafter, the CPU 401 determines whether the distance between the temperature sensed by the central temperature sensor 121 and the temperature sensed by the end temperature sensor 122 (also referred to as a "temperature difference", below) is smaller than a predetermined threshold X (step S103).

When the CPU 401 determines that the temperature difference is smaller than the predetermined threshold X in step S103, the CPU 401 starts rotating the fixing belt 411 (step S104).

More specifically, the CPU 401 starts rotating the pressing roller 46 to start rotating the fixing belt 411.

Here, in the present exemplary embodiment, the CPU 401 controls rotation of the fixing belt 411 on the basis of the temperature sensed by the temperature sensors 120.

More specifically, as described above, the CPU 401 starts rotating the fixing belt 411 when the temperature difference is smaller than the predetermined threshold X.

Here, when the temperature of the lubricant varies in the axial direction of the fixing belt 411, the fixing belt 411 moves smoothly over a portion with the lubricant with a high temperature, and moves less smoothly over a portion with the lubricant with a low temperature.

More specifically, at the portion with the lubricant with a high temperature, the lubrication between the heat source 413 and the fixing belt 411 is enhanced to move the fixing belt 411 smoothly. At the portion with the lubricant with a low temperature, the lubrication between the heat source 413 and the fixing belt 411 is degraded to hinder the fixing belt 411 from moving.

More specifically, in the present exemplary embodiment, an amount of heat radiated at the end of the fixing belt 411 in the axial direction of the fixing belt 411 is greater than an amount of heat radiation at the center of the fixing belt 411 in the axial direction of the fixing belt 411.

Figure 6:
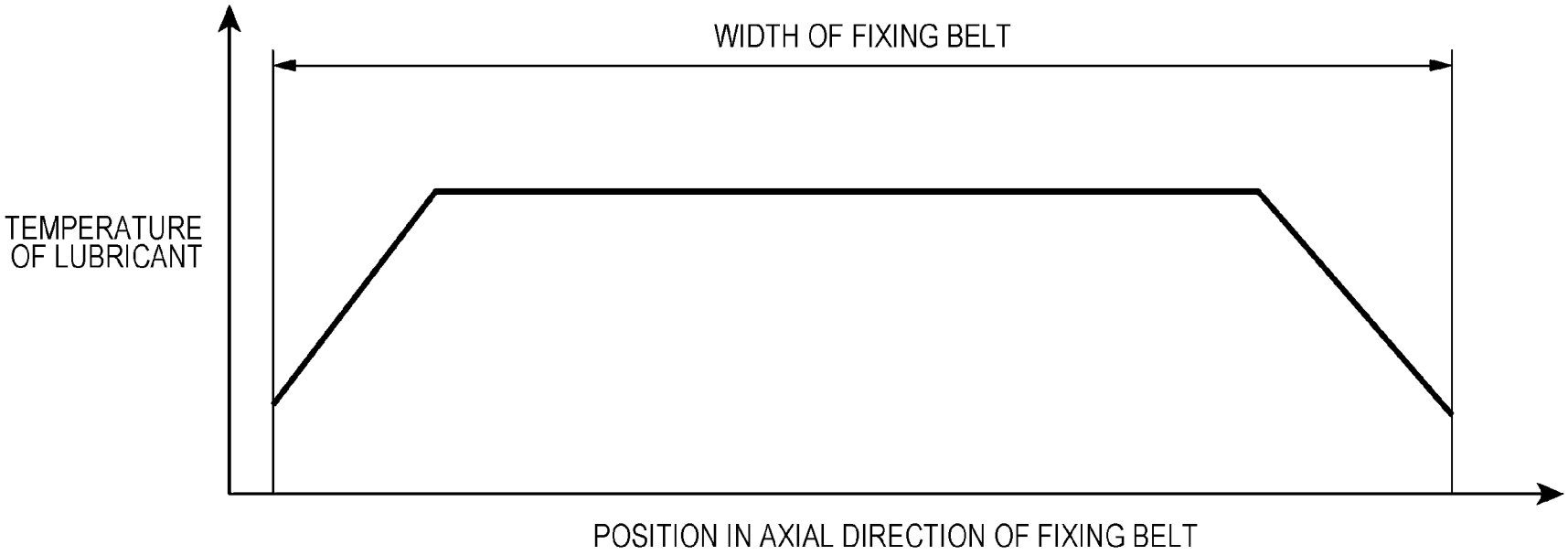
FIG. 6 illustrates temperature distribution of a lubricant.

In this case, as illustrated in FIG. 6 (illustrating temperature distribution of the lubricant), the temperature of the lubricant at the ends of the fixing belt 411 in the axial direction of the fixing belt 411 is lower than the temperature of the lubricant at the center of the fixing belt 411 in the axial direction of the fixing belt 411.

In this case, the fixing belt 411 moves less smoothly at the ends of the fixing belt 411 in the axial direction of the fixing belt 411, and is more likely to be deformed, such as twisted.

Deformation of the fixing belt 411 may bring damages on the fixing belt 411 or degradation of the quality of images fixed on the sheet P.

On the other hand, the structure according to the exemplary embodiment starts rotating the fixing belt 411 when the temperature of the lubricant varies to a lesser extent, and thus prevents deformation of the fixing belt 411 attributable to variation of the temperature of the lubricant.

This structure thus prevents damages on the fixing belt 411 or degradation of the image quality.

More specifically, in the fixing device 40 according to the present exemplary embodiment, the temperature difference is large immediately after electricity starts being fed to the first heating element 413A (refer to FIG. 4) and the second heating element 413B.

However, in the present exemplary embodiment, outputs from the first end heating unit H28 and the second end heating unit H29 are larger than the output from the central heating unit H1, and thus the temperature difference is gradually reduced with elapse of the time.

More specifically, in the present exemplary embodiment, the temperature of the lubricant at the ends of the fixing belt 411 approaches the temperature of the lubricant at the center of the fixing belt 411 with elapse of the time to reduce the temperature difference.

In the present exemplary embodiment, as described above, in response to the temperature difference falling below the predetermined threshold X, rotation of the fixing belt 411 is started.

Thus, deformation of the fixing belt 411 is prevented, and a damage on the fixing belt 411 or degradation of the image quality attributable to deformation of the fixing belt 411 is prevented.

The present exemplary embodiment has been described taking, as an example, a case where the fixing belt 411 starts rotating in response to the temperature difference falling below the predetermined threshold X.

Alternatively, the rotation speed of the fixing belt 411 may be increased in response to the temperature difference falling below the predetermined threshold X.

Here, to increase the rotation speed of the fixing belt 411, for example, rotation of the fixing belt 411 is started at a low speed after the operation in step S101 (refer to FIG. 5) is finished.

When, in step S103, the temperature difference is determined to fall below the predetermined threshold X, the rotation speed of the fixing belt 411 is increased. In other words, the fixing belt 411 is accelerated.

Also in this case, deformation of the fixing belt 411 attributable to acceleration of the fixing belt 411 is prevented, and a damage on the fixing belt 411 or degradation of the image quality attributable to acceleration of the fixing belt 411 is prevented.

The fixing belt 411 is more likely to be deformed when using, as a lubricant, a grease-based lubricant instead of an oil-based lubricant.

Figure 7:
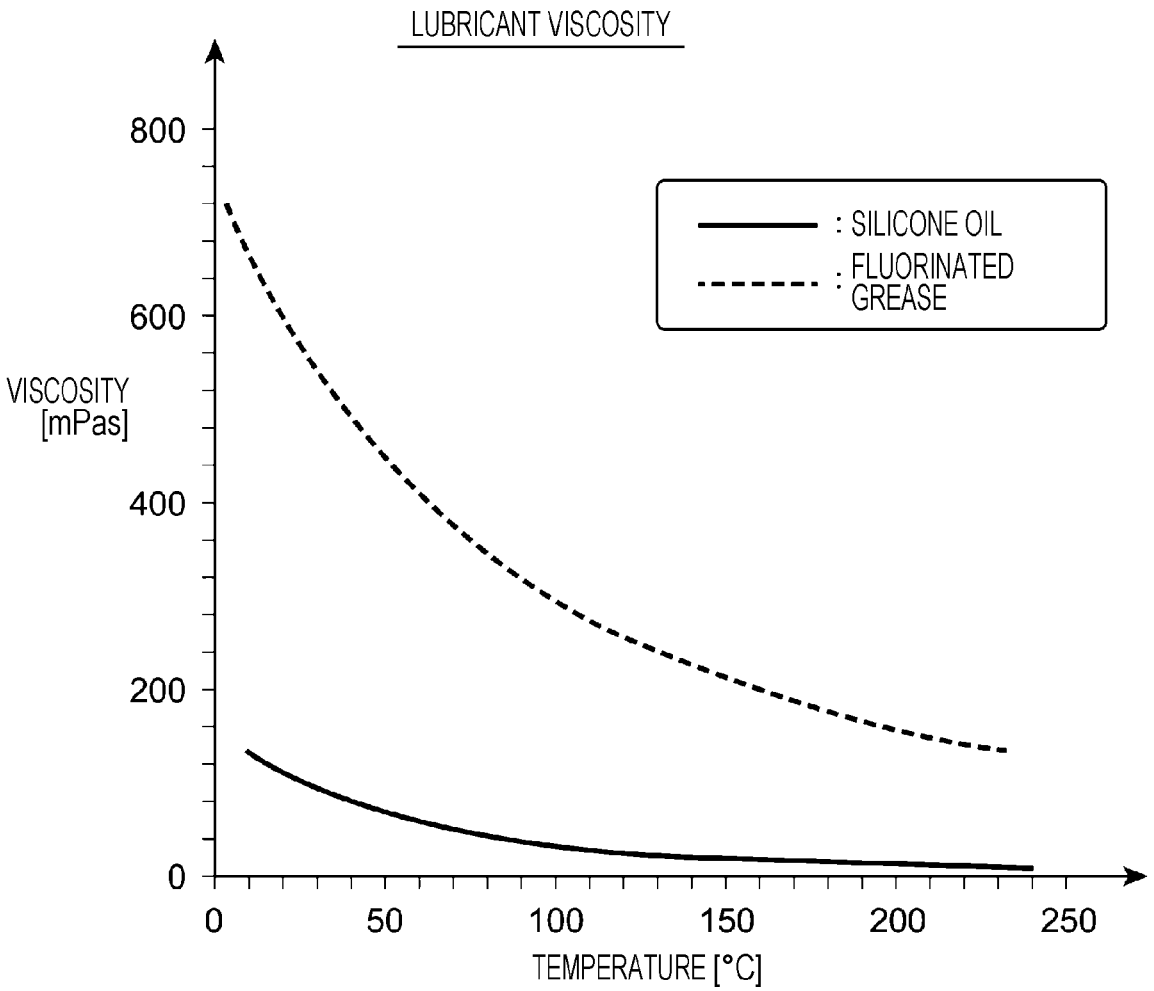
FIG. 7 illustrates viscosity of silicone oil and fluorinated grease, which are examples of a lubricant.

FIG. 7 illustrates the viscosity of silicone oil and fluorinated grease, which are examples of a lubricant.

Both of silicone oil and fluorinated grease increase their viscosity in accordance with reduction of the temperature. However, the viscosity of the fluorinated grease increases at a higher rate in accordance with reduction of the temperature than the viscosity of silicone oil.

When fluorinated grease is used as a lubricant, the above-described temperature difference hinders part of the fixing belt 411 from moving smoothly compared to the case where silicone oil is used. In this case, the fixing belt 411 is more likely to be deformed.

The image forming apparatus 1 according to the present exemplary embodiment is capable of changing the predetermined threshold X.

More specifically, in the present exemplary embodiment, the display device 90 (refer to FIG. 1) displays a screen (not illustrated) for changing the threshold X. The predetermined threshold X is changed by a user inputting a new threshold X through the screen.

The threshold X may be changed by the CPU 401. In this case, the threshold X is changed automatically.

When the threshold X is changed by the CPU 401, the CPU 401 changes the threshold X on the basis of information of, for example, time of use of the fixing device 40.

Here, "information of time of use" is not limited to the operation time of the fixing device 40. The "information of time of use" also includes information other than the operation time that increases in accordance with the time of use of the fixing device 40, such as the number of sheets P subjected to the fixing operation at the fixing device 40.

Here, when the CPU 401 changes the threshold X on the basis of the information of time of use (referred to as "use time information", below) of the fixing device 40, the CPU 401 lowers the threshold X further when, for example, the value specified by the use time information exceeds a predetermined value than when the value does not exceed the predetermined value.

Here, the viscosity of the lubricant may increase in accordance with the time of use of the fixing device 40. Here, the fixing belt 411 is more likely to be deformed.

More specifically, in accordance with the time of use of the fixing device 40, the amount of, for example, paper dust contaminated in the lubricant increases, the viscosity of the lubricant increases accordingly, and the fixing belt 411 is more likely to be deformed. More specifically, in this case, at the portion with the lubricant with a low temperature, the fixing belt 411 moves less smoothly, and the fixing belt 411 is more likely to be deformed.

When, as described above, the CPU 401 lowers the threshold X, the CPU 401 starts rotating or accelerating the fixing belt 411 while the temperature of the lubricant varies to a lesser extent. In this case, deformation of the fixing belt 411 is prevented.

In the above structure, the central temperature sensor 121 and the end temperature sensor 122 sense the temperature of the heat source 413, which comes into contact with the lubricant, to sense the temperature of the lubricant.

More specifically, the heat source 413 is a heating member that heats the fixing belt 411. The central temperature sensor 121 and the end temperature sensor 122 sense the temperature of the heating member to sense the temperature of the lubricant.

Instead, the temperature sensors 120 may be disposed to directly come into contact with the lubricant to directly sense the temperature of the lubricant.

More specifically, for example, the temperature sensors 120 may be disposed at portions opposing the inner peripheral surface 411D (refer to FIG. 3) of the fixing belt 411 to directly sense the temperature of the lubricant adhering to the inner peripheral surface 411D.

Alternatively, the temperature of the lubricant may be contactlessly sensed by, for example, a thermography.

In the above structure, the fixing belt 411 is rotated or accelerated when the difference between the temperature sensed by the central temperature sensor 121 and the temperature sensed by the end temperature sensor 122 is smaller than the predetermined threshold X.

More specifically, in the above structure, the fixing belt 411 is rotated or accelerated when the temperature difference between the two temperatures is smaller than the predetermined threshold X.

Alternatively, rotation of the fixing belt 411 may be controlled with an additional condition where the fixing belt 411 is rotated or accelerated when the lower one of the two temperatures is larger than a predetermined threshold.

In other words, the fixing belt 411 may be rotated or accelerated when the difference between the temperature sensed by the central temperature sensor 121 and the temperature sensed by the end temperature sensor 122 is smaller than the predetermined threshold X and the lower one of these two temperatures is larger than a predetermined threshold (a threshold different from the threshold X).

Even when the difference between the two temperatures is smaller, if the two temperatures are low, the lubricant has high viscosity and the fixing belt 411 rotates less smoothly.

As described above, when the fixing belt 411 is rotated or accelerated with the lower temperature exceeding the predetermined threshold, the fixing belt 411 is rotated or accelerated while the lubricant has a relatively high temperature. Here, the fixing belt 411 rotates more smoothly.

In the above structure, whether the fixing belt 411 is to be rotated or accelerated is determined on the basis of the temperature sensed by the central temperature sensor 121 and the temperature sensed by the end temperature sensor 122.

Instead, for example, whether the fixing belt 411 is to be rotated or accelerated may be determined on the basis of only the temperature sensed by the end temperature sensor 122.

In other words, the CPU 401 may determine whether the fixing belt 411 is to be rotated or accelerated on the basis of only the temperature of the lubricant at the end of the fixing belt 411 in the axial direction of the fixing belt 411.

More specifically, in this case, the CPU 401 starts rotating the fixing belt 411 or increases the rotation speed of the fixing belt 411 when the temperature of the lubricant at the end of the fixing belt 411 in the axial direction of the fixing belt 411 is larger than a predetermined threshold.

Here, in the present exemplary embodiment, outputs of the first end heating unit H28 and the second end heating unit H29 at the ends in the axial direction of the fixing belt 411 are larger than an output of the central heating unit H1.

Here, it is assumed that the temperature difference is reduced when the temperature of the lubricant at the end of the fixing belt 411 in the axial direction of the fixing belt 411 rises above the predetermined threshold.

Thus, the CPU 401 may determine to rotate or accelerate the fixing belt 411, not necessarily on the basis of the temperature difference, but on the basis of only the temperature of the lubricant at the end of the fixing belt 411 in the axial direction of the fixing belt 411.

Besides, the CPU 401 may further adjust the temperature of the lubricant when specific conditions are satisfied while, for example, the sheets P are not transported.

More specifically, the CPU 401 may control the first heating element 413A (refer to FIG. 4) and the second heating element 413B so that the difference between the temperature sensed by the central temperature sensor 121 and the temperature sensed by the end temperature sensor 122 falls below a predetermined threshold to adjust the temperature of the lubricant.

More specifically, the CPU 401 controls the first heating element 413A and the second heating element 413B while, for example, rotating the fixing belt 411 or stopping rotation of the fixing belt 411 when, for example, the sheets P are not transported without receiving an image formation start instruction.

More specifically, the CPU 401 controls the first heating element 413A and the second heating element 413B to make the difference between the temperature sensed by the central temperature sensor 121 and the temperature sensed by the end temperature sensor 122 lower than a predetermined threshold (may be the same as or different from the threshold X).

More specifically, the CPU 401 controls the first heating element 413A and the second heating element 413B to make the difference between the temperature sensed by the central temperature sensor 121 and the temperature sensed by the end temperature sensor 122 smaller than a predetermined threshold and to make the lower one of these two temperatures larger than a predetermined threshold.

This structure enables image formation to be started earlier in response to a subsequent image formation start instruction.

The present disclosure has been described using an electrophotographic image forming apparatus, but not limited to the electrophotographic image forming apparatus. The present disclosure is also applicable to, for example, an inkjet image forming apparatus that comes into contact with a sheet carrying an undried image formed from ink (unfixed ink image) to fix the unfixed ink image onto the sheet.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. A fixing device, comprising:

an annular and rotatable fixing member having an outer peripheral surface that comes into contact with a recording medium, the fixing member fixing an image on the recording medium onto the recording medium;

a contact member that is in contact with an inner peripheral surface of the fixing member, and extends in an axial direction of the fixing member;

at least one temperature sensing unit that senses a temperature of a lubricant adhering to the inner peripheral surface of the fixing member; and a processor configured to control rotation of the fixing member on a basis of a temperature sensed by the at least one temperature sensing unit.

2. The fixing device according to claim 1, wherein the at least one temperature sensing unit senses a temperature of a component that is in contact with the lubricant to sense a temperature of the lubricant.

3. The fixing device according to claim 2, wherein the contact member is a heating member that heats the fixing member, and wherein the at least one temperature sensing unit senses a temperature of the heating member to sense the temperature of the lubricant.

4. The fixing device according to claim 1, wherein the at least one temperature sensing unit includes a plurality of temperature sensing units arranged at different positions in the axial direction, and wherein the processor starts rotating the fixing member or increases rotation speed of the fixing member when a difference between a temperature sensed by a first one of the plurality of temperature sensing units and a temperature sensed by a second one of the plurality of temperature sensing units falls below a predetermined threshold.

5. The fixing device according to claim 4, wherein the processor starts rotating the fixing member or increases rotation speed of the fixing member when a lower one of the temperature sensed by the first temperature sensing unit and the temperature sensed by the second temperature sensing unit exceeds a predetermined threshold.

6. The fixing device according to claim 4, wherein the processor starts rotating the fixing member or increases rotation speed of the fixing member when a difference between a temperature sensed by one of the plurality of temperature sensing units disposed at an end of the fixing member in the axial direction of the fixing member and a temperature sensed by one of the plurality of temperature sensing units disposed at a center of the fixing member in the axial direction of the fixing member falls below the predetermined threshold.

7. The fixing device according to claim 4, wherein the predetermined threshold is changeable.

8. The fixing device according to claim 7, wherein the threshold is changed by the processor, and the processor changes the threshold on a basis of information of time of use of the fixing device.

9. The fixing device according to claim 8, wherein the processor lowers the threshold further, when a value specified on the basis of the information of time of use of the fixing device exceeds a predetermined value than when the value does not exceed the predetermined value.

10. The fixing device according to claim 1, wherein the processor starts rotating the fixing member or increases rotation speed of the fixing member when a temperature of the lubricant at an end of the fixing member in the axial direction of the fixing member exceeds a predetermined threshold.

11. The fixing device according to claim 1, wherein the processor also adjusts the temperature of the lubricant.

12. The fixing device according to claim 11, wherein the at least one temperature sensing unit includes a plurality of temperature sensing units arranged at different positions in the axial direction, and wherein the processor adjusts the temperature of the lubricant to make a difference between a temperature sensed by a first one of the plurality of temperature sensing units and a temperature sensed by a second one of the plurality of temperature sensing units smaller than a predetermined threshold.

13. An image forming apparatus, comprising:

an image forming device that forms an image on a recording medium;

an annular and rotatable fixing member having an outer peripheral surface that comes into contact with the recording medium on which the image is formed by the image forming device, the fixing member fixing the image on the recording medium onto the recording medium;

a contact member that is in contact with an inner peripheral surface of the fixing member, and extends in an axial direction of the fixing member;

a temperature sensing unit that senses a temperature of a lubricant adhering to the inner peripheral surface of the fixing member; and a processor configured to control rotation of the fixing member on a basis of a temperature sensed by the temperature sensing unit.

14. A fixing device, comprising:

annular and rotatable fixing means having an outer peripheral surface that comes into contact with a recording medium, the fixing means for fixing an image on the recording medium onto the recording medium;

contact means that is in contact with an inner peripheral surface of the fixing means, and extends in an axial direction of the fixing means;

temperature sensing means for sensing a temperature of a lubricant adhering to the inner peripheral surface of the fixing means; and processor means for controlling rotation of the fixing means on a basis of a temperature sensed by the temperature sensing means.

* * * * *